United States Patent [19]

Cassidy et al.

[11] 4,156,831

[45] May 29, 1979

[54] FLUORESCENT LAMP HAVING HEATER CIRCUIT DISCONNECT DEVICE

[75] Inventors: Robert E. Cassidy, Seabrook, N.H.; Frank M. Latassa, Magnolia; Tadius T. Sadoski, Salem, both of Mass.

[73] Assignee: GTE Sylvania Incorporated, Stamford, Conn.

[21] Appl. No.: 909,133

[22] Filed: May 24, 1978

[51] Int. Cl.[2] ..... H05B 41/18

[52] U.S. Cl. ..... 315/106; 313/285; 315/73; 315/107

[58] Field of Search ..... 315/46–49, 315/57, 73, 74, 94, 98, 106, 107, 119, 362; 328/270; 313/271, 285

[56] References Cited

U.S. PATENT DOCUMENTS

| | | | |
|---|---|---|---|
| 2,330,312 | 9/1943 | Raney, Jr. | 315/98 |
| 2,354,421 | 7/1944 | Pennybacker et al. | 315/73 X |
| 2,462,335 | 2/1949 | Reinhardt | 315/73 |
| 3,982,153 | 9/1976 | Burdick et al. | 315/106 X |

FOREIGN PATENT DOCUMENTS

| | | | |
|---|---|---|---|
| 65193 | 11/1946 | Denmark | 315/49 |

*Primary Examiner*—Eugene R. LaRoche

*Attorney, Agent, or Firm*—James Theodosopoulos

[57] ABSTRACT

A rapid start fluorescent lamp contains a circuit opening device on the cathode mount which opens a short time after lamp starting and stops heater current flow to the cathode. The circuit opening device is a thermostatic element in a sealed glass tube. Additional support is provided for the cathode end that is connected to the circuit opening device in order to prevent damage from vibration.

5 Claims, 1 Drawing Figure

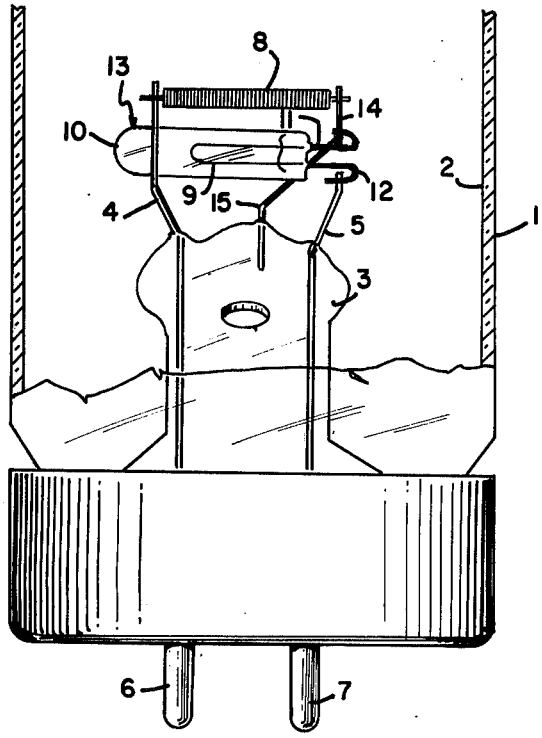
8
13
14
10
11
2
9
15
12
4
5
1
3
6
7

FLUORESCENT LAMP HAVING HEATER CIRCUIT DISCONNECT DEVICE

THE INVENTION

This invention is concerned with fluorescent lamps and especially with devices for shutting off the heater current to the electrode of a rapid start fluorescent lamp after the lamp has ignited. Such devices are used in order to save energy. Such energy-saving devices are disclosed in U.S. Pat. Nos. 4,052,687, Ser. No. 673,822 filed Apr. 5, 1976, now U.S. Pat. No. 4,097,779, and Ser. No. 673,823 filed Apr. 5, 1976, now U.S. Pat. No. 4,114,968, the disclosures of which are incorporated herein by reference.

We have found that there is a preferred location for the heater disconnect device in relation to the electrode, and that, in such location, the electrode needs more support than is disclosed in the aforementioned patents in order to prevent vibration from damaging the electrode's emissive coating.

The single FIGURE in the drawing is an elevational view, partly in section, of one end of a fluorescent lamp in accordance with this invention.

The lamp comprises a glass envelope 1 having a phosphor 2 thereon. A glass stem mount 3 is sealed to the end of envelope 1. Embedded in and extending through mount 3 are lead-in wires 4 and 5 which are connected to external pins 6 and 7 respectively. A coiled electrode 8 is connected to and supported on the upper end of lead-in wire 4. Electrode 8 is the usual type of electrode used in rapid start fluorescent lamps and contains the usual emissive coating thereon. Electrode 8 is also sometimes called a cathode or a heater. The other end of electrode 8 is connected to lead-in wire 5 through a thermally sensitive switch 13 which, in this embodiment, comprises a bimetal 9 within a glass bottle 10. Bimetal 9 is normally closed at room temperature and is electrically connected between electrode 8 and lead-in wire 5 by means of wires 11 and 12 which extend through glass bottle 10.

Switch 13 should be located close enough to electrode 8 to be heated to its opening temperature during normal lamp operation, but far enough away so that it will cool off and close in a reasonably short time after the lamp is extinguished. This will prevent an unnecessarily long time for reignition of the lamp to occur, if desired, after the lamp has been extinguished. For this purpose the preferred distance between electrode 8 and switch should be about 2 to 6 mm and the preferred opening temperature of switch 13 should be about 100° to 200° C. Since this results in intermediate wire 14, which connects the right hand end of electrode 8 to wire 11, being relatively long, we provide additional support for said end of electrode 8 by the use of a support wire 15. One end of support wire 15 is embedded in glass mount 3 and the other end of support wire 15 is fastened to wire 14. This additional support reduces vibrational damage to the emissive coating on electrode 8. The embedded end of support wire 15 is unconnected to lead-in wires 4 and 5. If desired, support wire 15 can be directly connected to the right hand end of electrode 8 and wire 14 can be eliminated. In such a case, wire 11 would be connected to support wire 15.

In a specific example, envelope 10 of switch 13 was 15 mm long by 148 mils O.D. and was located 5 mm from electrode 8, substantially parallel thereto. Wires 4, 5 and 15 were 24 mils diameter. Switch 13 opened at a temperature of about 170° C.

We claim:

1. In a rapid start type of fluorescent lamp comprising an elongated glass envelope having a phosphor coating on the inner wall thereof and having an electrode at each end thereof and means to supply heater current to said electrode, the improvement which comprises a thermally actuable circuit opening device proximate said electrode, said device being normally closed at room temperature and thereby permitting heater current to flow through said electrode during lamp start up, said device becoming open after lamp ignition as a result of heat from said electrode, thereby stopping said heater current flow, said device comprising a bimetallic element enclosed in a sealed glass bottle and supported therein by two wires extending through the glass bottle seal, said electrode being mounted on a glass stem mount having two lead-in wires extending therethrough, one of said lead-in wires being connected to one end of said electrode, the other of said lead-in wires being connected to one of the wires that extends through the glass bottle seal, the other end of said electrode being connected to the other of the wires that extends through the glass bottle seal, and a support wire one end of which is embedded in the glass stem mount and the other end of which supports said other end of said electrode.

2. The lamp of claim 1 wherein there is an intermediate wire connected between said other end of said electrode and said other of the wires that extends through the glass bottle seal, and wherein said support wire is connected to said intermediate wire.

3. The lamp of claim 1 wherein the opening temperature of the switch is about 100° to 200° C.

4. The lamp of claim 1 wherein the glass bottle is substantially parallel to the electrode.

5. The lamp of claim 4 wherein the glass bottle is spaced about 2 to 6 mm from the electrode.

* * * * *